US008393388B2

(12) United States Patent
Bishop et al.

(10) Patent No.: US 8,393,388 B2
(45) Date of Patent: Mar. 12, 2013

(54) RETRACTABLE PETAL COLLET BACKUP FOR A SUBTERRANEAN SEAL

(75) Inventors: David S. Bishop, Houston, TX (US); Dennis E. Kroll, League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/857,259

(22) Filed: Aug. 16, 2010

(65) Prior Publication Data

US 2012/0037355 A1 Feb. 16, 2012

(51) Int. Cl.
*E21B 33/128* (2006.01)

(52) U.S. Cl. ..... 166/119; 166/387

(58) Field of Classification Search ..... 166/118, 166/206, 386, 119, 196, 134, 135, 387; 277/323, 277/339, 611, 616, 638
See application file for complete search history.

(56) References Cited

U.S. PATENT DOCUMENTS 3,292,938 A * 12/1966 Tamplen ..... 277/337
3,420,307 A * 1/1969 Conrad ..... 166/134
3,450,204 A * 6/1969 Brown et al. ..... 166/124
3,554,280 A * 1/1971 Tucker ..... 166/134
3,666,010 A * 5/1972 Harris ..... 166/134
4,281,840 A * 8/1981 Harris ..... 277/342
4,611,658 A * 9/1986 Salerni et al. ..... 277/337
4,745,972 A * 5/1988 Bell et al. ..... 277/338
4,765,404 A * 8/1988 Bailey et al. ..... 166/117.6
RE32,831 E 1/1989 Shonrock et al.
5,215,145 A 6/1993 Ross
5,261,492 A * 11/1993 Duell et al. ..... 166/387
5,271,468 A * 12/1993 Streich et al. ..... 166/387
5,390,737 A * 2/1995 Jacobi et al. ..... 166/184
5,511,620 A 4/1996 Baugh et al.
5,613,555 A 3/1997 Sorem et al.
5,678,635 A * 10/1997 Dunlap et al. ..... 166/387
5,701,954 A * 12/1997 Kilgore et al. ..... 166/119
5,829,524 A 11/1998 Flanders et al.
5,857,520 A * 1/1999 Mullen et al. ..... 166/196
5,941,313 A 8/1999 Arizmendi
5,944,102 A * 8/1999 Kilgore et al. ..... 166/119
6,112,811 A * 9/2000 Kilgore et al. ..... 166/134
6,164,375 A 12/2000 Carisella
6,311,778 B1 11/2001 Carisella et al.
6,318,460 B1 11/2001 Swor et al.

(Continued)

OTHER PUBLICATIONS

Garfield, Garry, et al., "Recent Metal-to-Metal Sealing Technology for Zonal Isolation Applications Demonstrates Potential for Use in Hostile HP/HT Environments", SPE/IADC 105854, Feb. 2007, 1-4.

(Continued)

*Primary Examiner* — Daniel P Stephenson
(74) *Attorney, Agent, or Firm* — Steve Rosenblatt

(57) ABSTRACT

A high expansion plug has multiple sealing elements and an extrusion barrier system that uses overlapping petals in a stack of rings. When setting the plug, the petals are elastically moved toward a surrounding tubular wall in an elastic deformation between a housing that surrounds the mandrel and a tapered ring on the mandrel. That sandwich controls the amount of deformation and allows a potential energy force to be stored in the petals that allows them to return toward their initial position when the set of the plug is released and the seals are allowed to relax and extend axially as they shrink radially. The plug can then be removed without milling. Expansions in the order of 25% of the initial seal dimension are contemplated.

16 Claims, 3 Drawing Sheets

U.S. PATENT DOCUMENTS

| | | | | |
|---|---|---|---|---|
| 6,318,461 | B1 | 11/2001 | Carisella | |
| 6,536,532 | B2 * | 3/2003 | Doane | 166/387 |
| 6,666,276 | B1 * | 12/2003 | Yokley et al. | 166/387 |
| 6,695,051 | B2 * | 2/2004 | Smith et al. | 166/134 |
| 6,705,615 | B2 | 3/2004 | Milberger et al. | |
| 6,712,153 | B2 * | 3/2004 | Turley et al. | 166/387 |
| 6,715,560 | B2 * | 4/2004 | Doane et al. | 166/387 |
| 6,769,491 | B2 * | 8/2004 | Zimmerman et al. | 166/387 |
| 6,779,602 | B1 | 8/2004 | Van Bilderbeek et al. | |
| 6,796,376 | B2 * | 9/2004 | Frazier | 166/134 |
| 6,827,150 | B2 * | 12/2004 | Luke | 166/387 |
| 6,848,505 | B2 | 2/2005 | Richard et al. | |
| 6,962,206 | B2 | 11/2005 | Hirth et al. | |
| 7,004,248 | B2 * | 2/2006 | Hoffman et al. | 166/191 |
| 7,128,145 | B2 | 10/2006 | Mickey | |
| 7,373,973 | B2 * | 5/2008 | Smith et al. | 166/134 |
| 7,392,841 | B2 | 7/2008 | Murray et al. | |
| 7,475,736 | B2 * | 1/2009 | Lehr et al. | 166/386 |
| 7,478,679 | B2 | 1/2009 | Berzin et al. | |
| 7,510,015 | B2 | 3/2009 | Corre et al. | |
| 7,552,768 | B2 | 6/2009 | O'Brien | |
| 7,578,353 | B2 * | 8/2009 | Cook et al. | 166/387 |
| 7,621,322 | B2 | 11/2009 | Arnold et al. | |
| RE41,118 | E * | 2/2010 | Brezinski et al. | 166/387 |
| 7,717,179 | B2 * | 5/2010 | Rayssiguier et al. | 166/285 |
| 7,743,825 | B2 | 6/2010 | O'Malley et al. | |
| 7,743,836 | B2 * | 6/2010 | Cook et al. | 166/387 |
| 7,789,137 | B2 * | 9/2010 | Turley et al. | 166/138 |
| 8,037,942 | B2 * | 10/2011 | Vinson et al. | 166/387 |
| 8,127,978 | B2 | 3/2012 | Castillo et al. | |
| 8,151,873 | B1 | 4/2012 | Lee et al. | |
| 2003/0226659 | A1 * | 12/2003 | Smith et al. | 166/118 |
| 2003/0226668 | A1 * | 12/2003 | Zimmerman et al. | 166/387 |
| 2004/0036225 | A1 | 2/2004 | Ritter et al. | |
| 2004/0069502 | A1 * | 4/2004 | Luke | 166/387 |
| 2004/0149429 | A1 | 8/2004 | Dilber et al. | |
| 2004/0216868 | A1 * | 11/2004 | Owen, Sr. | 166/134 |
| 2005/0115720 | A1 | 6/2005 | MacKenzie et al. | |
| 2006/0289173 | A1 * | 12/2006 | Conaway et al. | 166/387 |
| 2007/0056725 | A1 | 3/2007 | Lucas et al. | |
| 2007/0102165 | A1 * | 5/2007 | Slup et al. | 166/387 |
| 2007/0199693 | A1 * | 8/2007 | Kunz | 166/179 |
| 2007/0199716 | A1 * | 8/2007 | Ruttley et al. | 166/338 |
| 2007/0210525 | A1 | 9/2007 | Saltel | |
| 2008/0060821 | A1 * | 3/2008 | Smith et al. | 166/387 |
| 2009/0065191 | A1 | 3/2009 | Reid et al. | |
| 2009/0145614 | A1 * | 6/2009 | Cook et al. | 166/387 |
| 2009/0255690 | A1 | 10/2009 | Conner et al. | |
| 2010/0258311 | A1 | 10/2010 | Craig et al. | |
| 2010/0276137 | A1 | 11/2010 | Nutley et al. | |
| 2011/0036561 | A1 | 2/2011 | Bishop et al. | |
| 2011/0079383 | A1 | 4/2011 | Porter et al. | |
| 2011/0315373 | A1 | 12/2011 | O'Connell | |

OTHER PUBLICATIONS

Aldrige, Don, "Multi Zone Completions Design Considerations", SPE 35229, Mar. 1996, 671-674.

* cited by examiner

RETRACTABLE PETAL COLLET BACKUP FOR A SUBTERRANEAN SEAL

FIELD OF THE INVENTION

The field of the invention is high expansion packers and more particularly those that can be retrieved while using overlapping petals to form backup rings.

BACKGROUND OF THE INVENTION

High expansion packers are used in through tubing applications where the packer or plug is then set in casing below the tubing through which it was delivered. Some designs provided cup shaped backup ring stacks that has staggered slots as between layers as an extrusion barrier in expansion ranges up to 25%. U.S. Pat. No. 6,827,150 is an illustration of one such design. Others are U.S. Pat. No. 7,128,145; US Publication 2004/0149429 and 2005/0115720. Other high expansion packer designs are U.S. Pat. No. Re 32,831; U.S. Pat. Nos. 6,311,778; 6,318,461 and 6,164,375.

The high expansion designs have focused on the need to prevent extrusion as a result of the combination of high expansion and differential pressure. The stack of backup rings were deformed against the surrounding tubular in a way that made the high expansion plug of the prior design removable by milling it apart. What has been needed in high expansion applications is a retrievable design that performs as needed to prevent element extrusion under pressure differentials typically seen for such plugs.

The present invention addresses this issue by using an overlapping petal design for the backup rings but disposing the rings in a manner where the assembly has a low profile for run in and that guides the flexing of the petals toward the surrounding tubular when in the set position. Support is offered to the petals by a housing on one side and a tapered guide ring on another side. As a result the petals elastically deform to act as a backup to the sealing elements and when the plug is unset and the sealing elements are able to release from the surrounding tubular using the stored potential energy from the elastic deformation that occurred when the plug was set. Minor image orientations of sealing elements and backup rings address differential pressures in opposed directions. Those skilled in the art will better understand the invention from a review of the description of the preferred embodiment and the associated drawings while recognizing that the full scope of the invention is determined by the claims appended below.

SUMMARY OF THE INVENTION

A high expansion plug has multiple sealing elements and an extrusion barrier system that uses overlapping petals in a stack of rings. When setting the plug, the petals are elastically moved toward a surrounding tubular wall in an elastic deformation between a housing that surrounds the mandrel and a tapered ring on the mandrel. That sandwich controls the amount of deformation and allows a potential energy force to be stored in the petals that allows them to return toward their initial position when the set of the plug is released and the seals are allowed to relax and extend axially as they shrink radially. The plug can then be removed without milling. Expansions in the order of more than 25% of the initial seal dimension are contemplated.

DETAILED DESCRIPTION OF THE PREFERRED EMBODIMENT

Figure 1A:
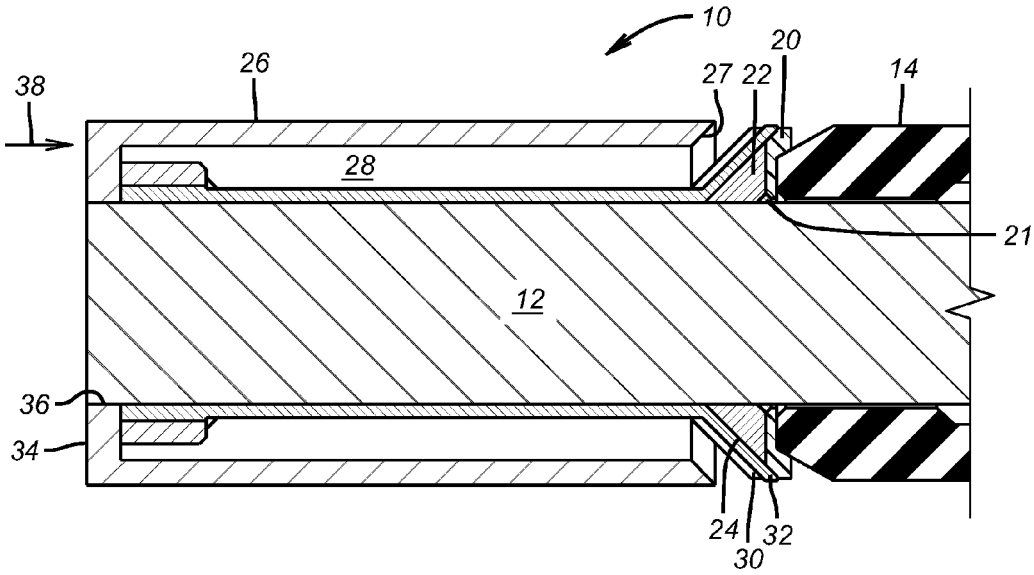
FIGS. 1*a*-1*b* show the plug in the run in position.
Figure 1B:
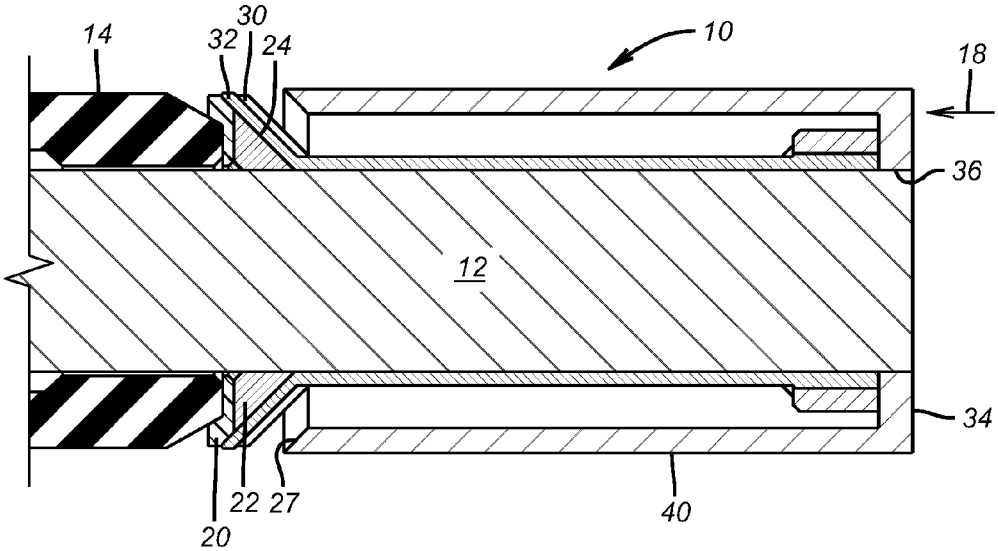

FIG. 1*a* is the upper end of the plug 10 while FIG. 1*b* is the mirror image lower end of the plug 10. A mandrel 12 extends into both parts of FIG. 1 and supports the sealing element 14.

Figure 2A:
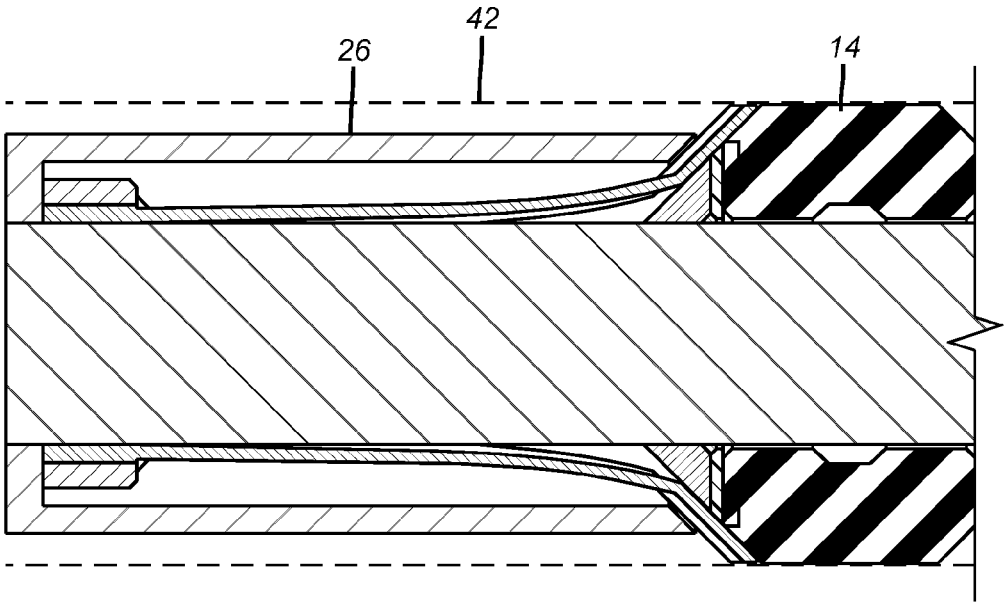
FIGS. 2*a*-2*b* show the plug in the set position.
Figure 2B:
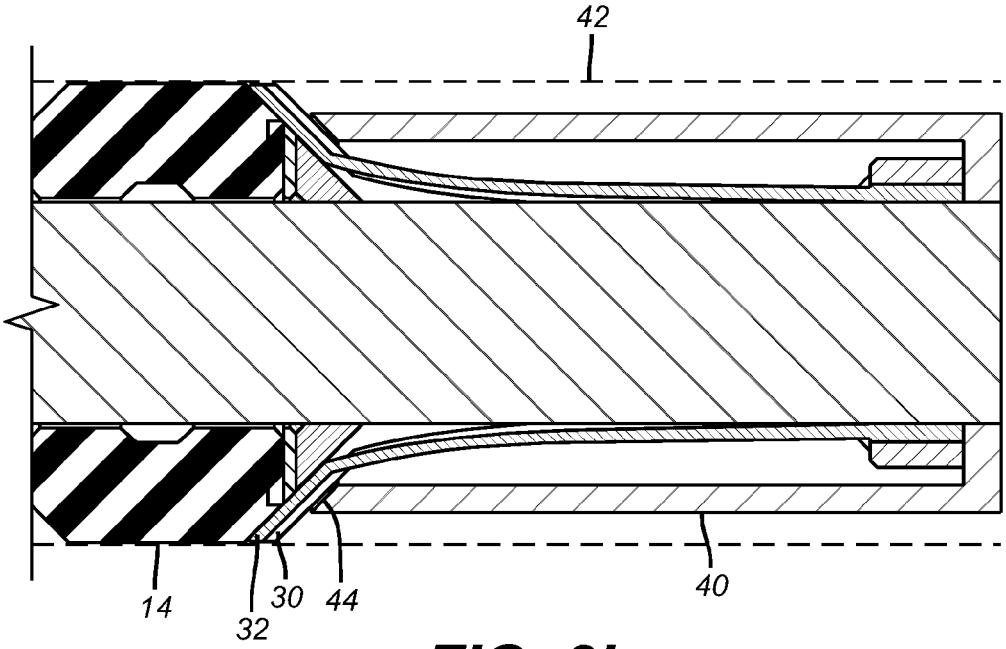
Figure 3:
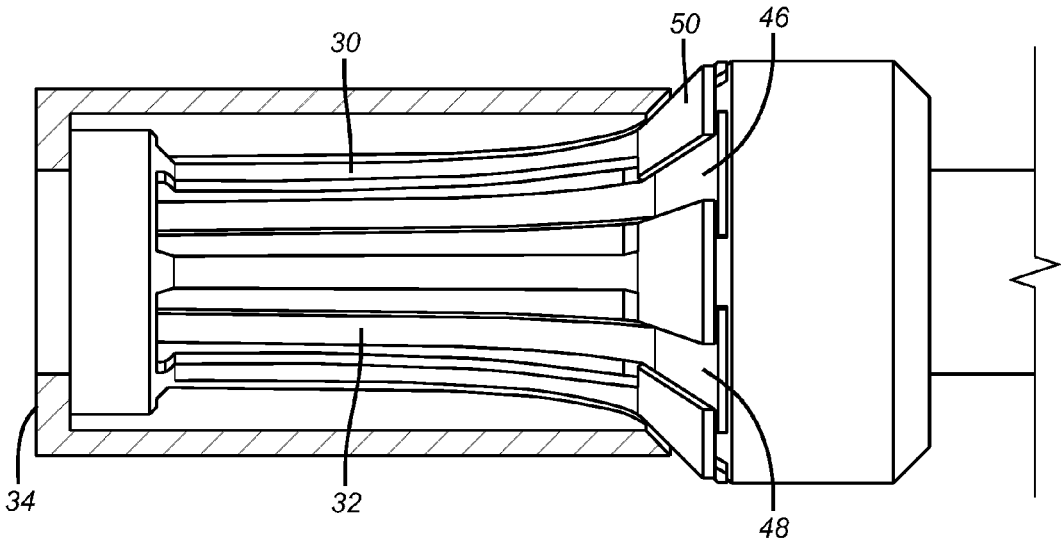
FIG. 3 is an enlarged view showing the petal assembly extending into its supporting housing.

A backup ring 20 that is preferably PTFE or Amadil® is adjacent to a ramp ring 22. Both rings are mounted over the mandrel 12 and are slidably mounted with respect to the mandrel 12. Ring 21 sits on the mandrel 12 and is preferably made of PEEK. It is there to resist extrusion of the element 14 along the mandrel 12 as shown in FIG. 2. Together they present a barrier for the rubber element 14 to prevent extrusion under and between the petal rings 30 and 32. As seen in FIG. 3 the petal rings or extendable backup rings 30 and 32 are formed from elongated flat steel members that in each ring overlap an adjacent petal. As between rings the spacing is circumferentially staggered so that the petals of one ring are not in alignment with petals of an adjacent ring. While two overlapping rings are shown, other numbers of rings can be used without departing from the invention. The rings of elongated petals are fixed at one end to a base 34 that is disposed inside an annular space 28 defined between a sleeve 26 and the mandrel 12. Sleeve 26 has a taper 27 that selectively contacts the stacked rings 30 and 32 in the FIG. 2 set position on the opposite side from ramp surface 24. The sleeve 26 has an opening 36 through which the mandrel 12 extends so that both the sleeve 26 and the base 34 and the elongated petal rings 30 and 32 that are supported with the base 34 can all be moved when the plug 10 is set by holding the mandrel 12 and using a setting sleeve that is schematically represented as arrow 38 in FIG. 1*a*. In essence, FIG. 1*a* is the minor image of FIG. 1*b* as between the seal 14 and the associated sleeve 40. With this arrangement the seal 14 can be retractably set with expansion ratio of over 25%.

In the set position of FIG. 2 the petal rings 30 and 32 are up against the casing or tubular 42 with the end 44 of the sleeve 40 against the stacked rings 30 and 32 on one side and the seal 14 on the other side. The same goes on at the opposite hand where the ring stacks 30 and 32 are up against the sleeve 26 on one side and the seal 14 on the other side. What has happened as a result of the relative motion created by the setting tool, schematically illustrated as 38 pushing all the parts against a travel stop schematically represented by arrow 18, is that the stacked rings that extend beyond the respective sleeves 26 or 40 have been elastically deflected to contact the surrounding tubular 42 to function as a backup to the adjacent respective seal while at the same time the rings 30 and 32 have been provided with sufficient support from opposing sides to keep them against the tubular 42 in the set position while still allowing the rings to retract if the plug 10 is unset. The reason this happens is that the portion of the overlapping rings 30 and 32 that extend from the respective sleeves is simply elastically bent so that springing back is still possible. The support provided from opposed ends to the petal rings gives them the strength to serve as extrusion barriers in the set position while still being retractable.

FIG. 3 shows two adjacent overlapping petals 46 and 48 from one ring and another petal 50 from an adjacent ring that is offset from both petals 46 and 48 to illustrate the juxtaposition of the adjacent rings of petals. The petals themselves are elongated preferably metallic structures that can have parallel sides or can flare toward the end extending from the adjacent sleeve. The sleeves can be secured for run in with shear pins or other breakable retainers. While mirror image configurations are preferred, other options are envisioned such as using only as single seal with the petal type backup to resist differential in a single direction rather than in the opposed directions as described above. Alternatively, there can be more than a single seal with the associated backup as described above that resists pressure differential in a given direction.

The above description is illustrative of the preferred embodiment and many modifications may be made by those skilled in the art without departing from the invention whose scope is to be determined from the literal and equivalent scope of the claims below.

We claim:

1. A high expansion retrievable plug for subterranean use, comprising:

a mandrel supporting at least one sealing element set by compression to selectively seal against and release from a surrounding wall at a subterranean location;

at least one extendable backup ring mounted to a support, said backup ring disposed between said sealing element and said support, whereupon compression of said sealing element said backup ring flexes to contact said wall and said sealing element;

said support comprises a ramp on one side of said backup ring on which said backup ring slides and a ramped member on an opposite side of said backup ring from said ramp and initially axially spaced from said backup ring, whereupon axial compression of said sealing element said ramped member initially moves axially with respect to said sliding backup ring as said sliding backup ring slides on said ramp so that said ramped member then contacts said backup ring to retain said backup ring in contact with said wall and said sealing element.

2. The plug of claim 1, wherein:

said backup ring retracts from the wall when said compressive force acting on said sealing element is removed.

3. The plug of claim 1, wherein:

said support comprises an annular shape surrounding said mandrel to define an open annular space therebetween; and a taper disposed at an open end of said support.

4. The plug of claim 3, wherein:

said backup ring comprising a plurality of overlapping petals that extend beyond said taper and having a base within said annular space.

5. The plug of claim 4, wherein:

said at least one backup ring comprises a plurality of backup rings each having a plurality of overlapping petals with the petals of one ring circumferentially offset from the petals in an adjacent ring so that petal side surfaces are not in alignment.

6. The plug of claim 5, wherein:

said at least one sealing element comprises a plurality of sealing elements each with an associated backup ring, wherein at least two backup rings are oriented in minor image.

7. The plug of claim 6, wherein:

said sealing elements expand over 25% to contact the wall in the set position.

8. The plug of claim 1, wherein:

said backup ring comprising a plurality of overlapping petals that extend beyond said support.

9. The plug of claim 8, wherein:

said at least one backup ring comprises a plurality of backup rings each having a plurality of overlapping petals with the petals of one ring circumferentially offset from the petals in an adjacent ring so that petal side surfaces are not in alignment.

10. The plug of claim 9, wherein:

said petals comprise elongated flat metallic members with parallel or tapered side surfaces.

11. The plug of claim 8, wherein:

said petals are elastically deformed to contact the wall and supported when contacting said wall by a tapered member located between said petals and said sealing element on one side and said support on the opposite side of said petals.

12. The plug of claim 11, wherein:

said support is selectively movable with respect to said mandrel and has a leading taper to contact said petals.

13. The plug of claim 12, wherein:

said support comprises an annular shape surrounding said mandrel to define an open annular space therebetween; and said leading taper disposed at an open end of said support.

14. The plug of claim 13, wherein:

said overlapping petals extend beyond said leading taper and having a base within said annular space.

15. The plug of claim 14, wherein:

said petals move away from said wall when compression on said sealing element is released.

16. The plug of claim 15, wherein:

said sealing element expands over 25% to contact the wall in the set position.

* * * * *